US010648726B2

(12) United States Patent
Im et al.

(10) Patent No.: US 10,648,726 B2
(45) Date of Patent: May 12, 2020

(54) REFRIGERATOR

(71) Applicant: LG Electronics Inc., Seoul (KR)

(72) Inventors: Jihyun Im, Seoul (KR); Hyunbum Kim, Seoul (KR); Dongjeong Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 15/968,240

(22) Filed: May 1, 2018

(65) Prior Publication Data

US 2019/0056170 A1 Feb. 21, 2019

(30) Foreign Application Priority Data

Aug. 21, 2017 (KR) ..... 10-2017-0105255

(51) Int. Cl.
*F25D 25/02* (2006.01)
*F25D 23/06* (2006.01)
*F25D 23/02* (2006.01)

(52) U.S. Cl.
CPC ..... *F25D 25/024* (2013.01); *F25D 23/028* (2013.01); *F25D 23/067* (2013.01); *F25D 25/022* (2013.01); *F25D 25/027* (2013.01); *F25D 2323/021* (2013.01); *F25D 2325/021* (2013.01)

(58) Field of Classification Search
CPC .... F25D 25/024; F25D 25/022; F25D 25/028; F25D 25/067; F25D 2325/021
USPC ..... 312/404, 408, 242, 245–248; 108/15, 108/42–44, 48
See application file for complete search history.

(56) References Cited

U.S. PATENT DOCUMENTS 2,042,517 A * 6/1936 Ellis ..... F25D 25/02 108/135
2,199,102 A * 4/1940 Hough ..... E05D 1/00 16/355
2,287,611 A * 6/1942 Harbison ..... F25D 25/02 108/62

(Continued)

FOREIGN PATENT DOCUMENTS

EP 1564512 8/2005

OTHER PUBLICATIONS

EP Office Action in European Appln. No. 18168179.2, dated Nov. 28, 2018, 9 pages.

*Primary Examiner* — Daniel J Troy
*Assistant Examiner* — Timothy M Ayres
(74) *Attorney, Agent, or Firm* — Fish & Richardson P.C.

(57) ABSTRACT

A refrigerator includes a cabinet defining a storage compartment, a sliding shelf configured to discharge forward from the compartment, a folding shelf configured to, based on rotation of the folding shelf, switch positions between a first position in which the folding shelf is disposed along a plane of the sliding shelf and a second position in which the folding shelf is disposed transverse to the plane, a hinge unit configured to couple the folding shelf to a side surface of the compartment, a rotation stopper located on the side surface and configured to resist rotation of the folding shelf, and a supporter that is configured to support the folding shelf based on the folding shelf being disposed at the first position and that includes a protrusion at a bottom surface of the folding shelf, and a press portion at the hinge unit and configured to press the protrusion.

20 Claims, 8 Drawing Sheets

(56) References Cited

U.S. PATENT DOCUMENTS 2,517,385 A * 8/1950 Clark ..... F25D 25/02 108/134
3,381,636 A * 5/1968 Saiberlich ..... A47B 57/46 108/108
4,448,464 A * 5/1984 Reichert ..... F25D 25/027 312/322
4,613,996 A * 9/1986 Chase ..... A47D 5/003 5/135
5,340,209 A * 8/1994 Kolbe ..... F25D 25/024 312/334.46
5,813,741 A * 9/1998 Fish ..... F25D 25/024 108/108
6,032,310 A * 3/2000 Helmsderfer ..... A47D 5/003 5/136
7,270,385 B2 * 9/2007 Mathur ..... A47B 96/025 108/108
8,167,389 B2 * 5/2012 Han ..... F25D 23/02 16/250
8,376,483 B2 * 2/2013 Jung ..... F25D 25/02 211/153
8,640,482 B2 * 2/2014 Lim ..... F25D 25/02 312/408
8,740,322 B2 * 6/2014 Moon ..... F25D 25/024 312/408
8,814,287 B2 * 8/2014 Jang ..... F25D 25/024 108/17
8,915,561 B2 * 12/2014 Eichman ..... F25D 25/025 312/408
9,033,438 B2 * 5/2015 Kelly ..... F25D 25/024 108/102
9,127,876 B2 * 9/2015 Wilson ..... F25D 23/02
9,127,877 B2 * 9/2015 Lee ..... F25D 25/024
9,134,063 B2 * 9/2015 Lim ..... F25D 23/062
9,234,695 B1 * 1/2016 Dubina ..... F25D 23/028
2009/0293533 A1 12/2009 Lim et al.
2014/0265799 A1 9/2014 Eichman et al.
2017/0314847 A1 * 11/2017 Ozyuksel ..... F25D 23/067

* cited by examiner

REFRIGERATOR

CROSS-REFERENCE TO RELATED APPLICATIONS

This application claims the benefit of Korean Patent Application No. 10-2017-0105255, filed on Aug. 21, 2017, which is hereby incorporated by reference as if fully set forth herein.

FIELD

The present disclosure relates to a refrigerator and, more particularly, to a refrigerator including a shelf.

BACKGROUND

A refrigerator may keep food fresh by cooling a storage compartment based on repeating a refrigeration cycle.

For example, a refrigerator may include a compressor that may compress refrigerant, through a refrigeration cycle, into high-temperature and high-pressure refrigerant. The refrigerant compressed by the compressor may cool air while passing through a heat exchanger, and the cooled air may be supplied into a freezing compartment or a refrigerating compartment.

The refrigerator may have a configuration, in which the storage compartment is divided into the refrigerating compartment and the freezing compartment, and the freezing compartment may be at the upper side and the refrigerating compartment may be at the lower side. A door provided on the front side of the refrigerator may preserve cold air in the refrigerating compartment and the freezing compartment.

A side-by-side-type refrigerator may include a freezing compartment and a refrigerating compartment that are arranged side by side, for example, on the left and right sides, respectively. In some examples, another type of refrigerator may include a single storage compartment that may be located at the upper side or the lower side and that may be opened by two doors arranged side by side.

In some examples, the refrigerator door may include a basket that is provided on the rear surface of the door and configured to accommodate large articles. For example, the basket may protrude a considerable distance from the rear surface of the door, and therefore may cover the front side of the storage compartment even when the door is opened.

In some cases, when a user discharges a shelf from the storage compartment, the shelf may interfere with the basket if the user discharges the shelf to a desired distance or more, and it may be difficult to store a tall article in the storage compartment. In these cases, the shelf may limit the spatial utility of the storage compartment.

SUMMARY

The present disclosure describes a refrigerator that includes a shelf configured to discharge forward to a sufficient distance without interfering with a basket provided on a door in an open state.

The present disclosure also describes a refrigerator that includes a foldable shelf configured to store a tall article as well as a shelf that is dischargeable forward.

In addition, the present disclosure describes a refrigerator that includes a plurality of foldable shelves that are located on opposite side surfaces of a storage compartment, that are configured to store a larger number of tall items, and that are usable in an unfolded state to store a short article, resulting in a high spatial utility.

Additional advantages, objects, and features will be set forth in part in the following description, and in part will become apparent to those having ordinary skill in the art upon examination of the following or may be learned from practice. The objectives and other advantages may be realized and attained by the structure particularly pointed out in the written description and claims hereof as well as the appended drawings.

According to one aspect of the subject matter described in this application, a refrigerator includes a cabinet that defines a storage compartment and an opening at a front side of the storage compartment, a sliding shelf that is located in the storage compartment, that extends in a horizontal direction, and that is configured to discharge forward from the storage compartment, a folding shelf located in the storage compartment and configured to switch positions between a first position in which the folding shelf is disposed along a plane of the sliding shelf and a second position in which the folding shelf is disposed transverse to the plane, in which the folding shelf is configured to switch to the second position based on rotation of the folding shelf from the first position, a hinge unit configured to rotatably couple the folding shelf to a side surface of the storage compartment, a rotation stopper located on the side surface of the storage compartment and configured to resist rotation of the folding shelf, and a supporter configured to support the folding shelf based on the folding shelf being disposed at the first position, in which the supporter includes a protrusion located at a bottom surface of the folding shelf, and a press portion located at the hinge unit and configured to apply pressure to the protrusion.

Implementations according to this aspect may include one or more of the following features. For example, the press portion may be located at a lower side of the hinge unit and configured to apply pressure to the protrusion in the horizontal direction. In some examples, the press portion may include a contact portion that extends in a direction parallel to a side surface of the folding shelf and that is configured to face the side surface of the folding shelf to apply pressure to the protrusion. In some examples, the folding shelf defines a hinge insertion groove configured to receive a side of the hinge unit, and the protrusion is located vertically below the hinge insertion groove. In some examples, the hinge unit may include a hinge body coupled to the side surface of the storage compartment, and a hinge arm that extends from the hinge body, that is configured to insert into the hinge insertion groove, and that is configured to rotatably support the folding shelf, where the press portion is located between the hinge body and the hinge arm.

In some implementations, the refrigerator may further include a fixing unit that is located at the side surface of the storage compartment, that is configured to couple the hinge unit and the rotation stopper to the side surface of the storage compartment, and that is configured to support the hinge unit and the rotation stopper. The fixing unit may define a fixing groove that is recessed from a side of the fixing unit and that is configured to receive the hinge unit and the rotation stopper. The hinge unit may include a plurality of hinge units, and the rotation stopper is located between the plurality of hinge units.

In some implementations, the refrigerator may further include a cantilever that extends forward from a rear wall of the storage compartment and that is configured to support the sliding shelf, and a side-end support piece that is located at the cantilever and that is configured to support an inner side end of the folding shelf based on the folding shelf being disposed at the first position, where the hinge unit is configured to rotatably support an outer side end of the folding shelf that is opposite to the inner side end.

In some examples, the rotation stopper may be configured to apply resistance force to the folding shelf that restricts rotation of the folding shelf from the first position or from the second position. In some examples, the rotation stopper may include a fixing body coupled to the side surface of the storage compartment, a protruding arm that extends from the fixing body, that defines a plurality of holding grooves recessed from a distal end of the protruding arm, and that includes a stepped portion located between the plurality of holding grooves, and a holder configured to receive pressure from the folding shelf and to selectively insert to one of the plurality of holding grooves.

In some implementations, the refrigerator may further include a door rotatably coupled to the cabinet and configured to open and close at least a portion of the storage compartment, the door including a basket, where the folding shelf has a predetermined width to allow the sliding shelf to discharge forward without interference with the basket of the door based on the door opening the storage compartment. In some examples, the door may include a first door coupled to a first side of the cabinet, and a second door coupled to a second side of the cabinet. The folding shelf may include a first folding shelf configured to couple to a first side surface of the storage compartment, and a second folding shelf configured to couple to a second side surface of the storage compartment that is opposite to the first side surface.

In some implementations, a width of the sliding shelf is less than or equal to a distance between the basket of the door and a second side surface of the storage compartment based on the door opening the storage compartment. In some examples, the refrigerator may further include a shelf coupler that is located at the side surface of the storage compartment and that is configured to, based on the folding shelf being disposed at the second position, hold the folding shelf at the side surface of the storage compartment. In some examples, the first door may include a first basket, and the second door may include a second basket, where a width of the sliding shelf is less than or equal to a distance between the first basket and the second basket based on the first door and the second door opening the storage compartment.

In some implementations, the sliding shelf may be located between the first folding shelf and the second folding shelf. The hinge unit may include a first hinge unit located at the first side surface of the storage compartment, and a second hinge unit located at the second side surface of the storage compartment, where the first folding shelf is configured to rotate about the first hinge unit from the first position toward the first side surface of the storage compartment, and the second folding shelf is configured to rotate about the second hinge unit from the first position toward the second side surface of the storage compartment. A distance between an end of the first folding shelf in the first position to an end of the second folding shelf in the first position may be greater than or equal to the distance between the first basket and the second basket based on the first door and the second door opening the storage compartment.

In some implementations, the sliding shelf may include a plurality of sliding shelves that are arranged at different heights in the storage compartment, and the folding shelf is configured to rotate from at least one of the plurality of sliding shelves to define a space configured to receive an object having a height greater than a distance between the plurality of sliding shelves.

It is to be understood that both the foregoing general description and the following detailed description of the present disclosure are exemplary and explanatory and are intended to provide further explanation of the present disclosure as claimed.

DETAILED DESCRIPTION

Figure 1:
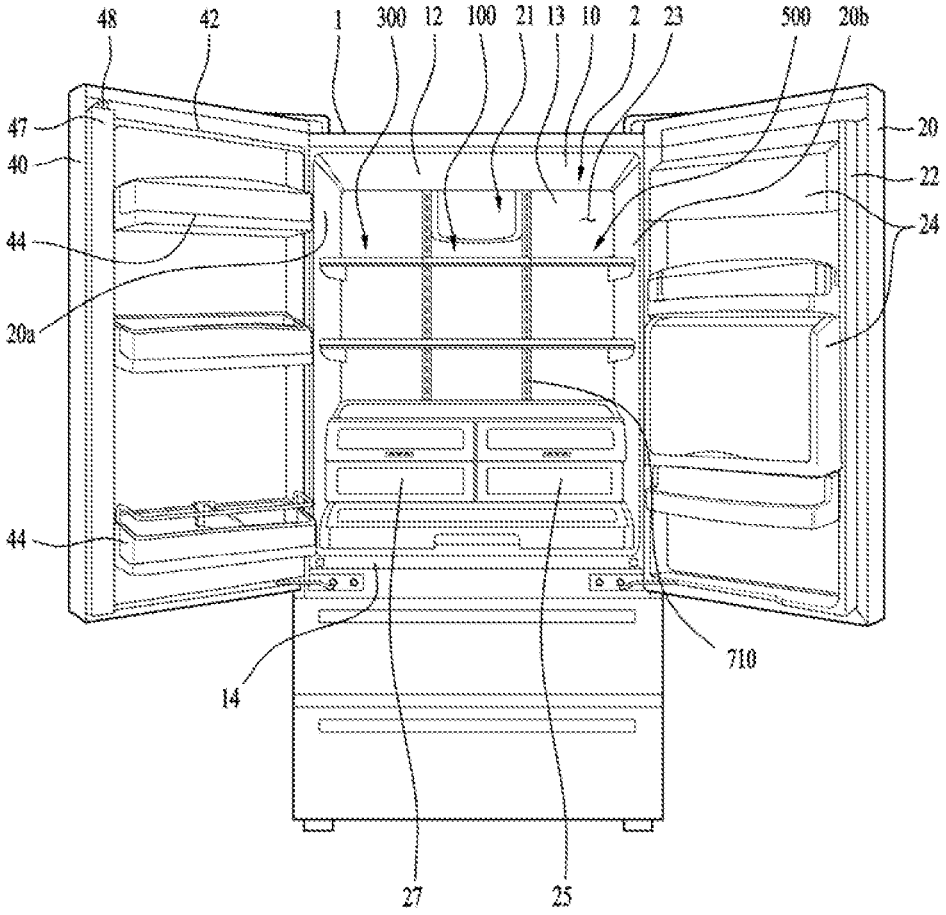
FIG. 1 is a front view illustrating an example refrigerator.

FIG. 1 illustrates an example refrigerator according to an implementation of the present disclosure. Referring to FIG. 1, the refrigerator includes a cabinet 1 that defines an external appearance of the refrigerator, and a storage space 2 that is defined in the cabinet 1 and configured to store food.

In some examples, a machine room may be located at the rear side of the storage space 2, and the machine room may include an evaporator of a refrigeration cycle configured to generate cold air and supply cold air to the storage space 2, a compressor configured to compress refrigerant, and a condenser configured to condense and transmit the compressed refrigerant to the evaporator.

An external appearance of the storage space 2 may be defined by an inner case 10 located inside of the cabinet 1. The inner case 10 may include a top surface 12, a rear wall 13, and a bottom surface 14, which define the inner surfaces of the storage space 2, and the front side of the storage space 2 may be open in order to allow a user to access the storage space 2 through the front side of the storage space 2. The top surface 12 may define the ceiling 12 of the storage space 2 or the top surface of the inner case 10.

The cabinet 1 may include a first door 20 at the front side, which is rotatably coupled to the cabinet 1 and configured to open and close one side of the storage space 2, and a second door 40, which is rotatably coupled to the cabinet 1 and configured to open and close the other side of the storage space 2. In some examples, when the first door 20 and the second door 40 close the front side of the storage space 2, the entire storage space 2 may be sealed. However, the present disclosure is not limited thereto, and any one of the first door 20 and the second door 40, or other plurality of doors may be provided. In some cases, a single door may open and close the storage space 2.

In some examples, a pillar 47 may be rotatably installed to the second door 40 and configured to come into contact with the first door 20. The pillar 47 may have a rectangular shape and may be coupled to the second door 40 so as to be rotated relative to the second door 40. In some examples, the pillar 47 may be positioned such that the rotated angle thereof relative to the second door 40 varies based on, for example, the angle by which the second door 40 is rotated relative to the storage space 2, or whether the first door 20 opens or closes the storage space 2.

The pillar 47 may have a shorter length than the distance between the top surface 12 and the bottom surface 14 of the inner case 10 so as not to come into contact with the top surface 12 and the bottom surface 14. For example, when the second door 40 is rotated to seal the storage space 2, the pillar 47 may not come into contact with both the top surface 12 and the bottom surface 14. In some examples, due to the structural shape of the inner case 10, where no element is disposed on the top surface 12 and the bottom surface 14 that can restrain the rotation of the pillar 47, each of the top surface 12 and the bottom surface 14 may form a single plane in its entirety.

In some examples, a pillar protrusion 48 may be located on the top side of the pillar 47. The pillar protrusion 48 may protrude so as not to come into contact with the top surface 12 (e.g., the ceiling 12).

The first door 20 may include a door dike 22, which defines a rear appearance of the first door 20. In addition, the second door 40 may include a door dike 42, which defines a rear appearance of the second door 40.

In some examples, baskets 24 and 44 may be installed to the respective door dikes 22 and 42, and may be used to store various shapes of food therein. In some examples, the basket 24, which is installed to the first door 20 that does not include the pillar 47, may not interfere with the pillar 47 when the first door 20 is rotated. In some cases, the basket 24 may have an angled corner. The basket 24 having an angled corner may store an increased amount of food compared to a basket having a rounded corner.

The storage space 2 may include a plurality of shelf units 21 that are arranged one above another. The storage space 2 may be divided into a plurality of storage compartments 2 by shelves. Some of the divided storage compartments may be divided by partitions, and each of the divided storage compartments may include a drawer, which may be introduced into and discharged from the respective storage compartments.

In some implementations, each shelf unit 21 may include a plurality of divided shelves. For example, when the storage space 2 is manufactured to be opened or closed by a single door, the shelf unit 21 may include a single folding shelf 300 or 500, which is rotatably provided at a position close to the side surface to which the door is installed, and a sliding shelf 100, which is provided on the side surface of the folding shelf and configured to discharge forward.

In some implementations, the storage space 2 may be opened and closed by the first door 20 and the second door 40. Based on the illustration of FIG. 1, the shelf unit 21 includes a first folding shelf 300, which is rotatably provided close to a left surface 20*a* to which the second door 40 is installed, a second folding shelf 500, which is rotatably provided close to a right surface 20*b* to which the first door 20 is installed, and the sliding shelf 100, which is provided between the first folding shelf 300 and the second folding shelf 500 so as to be dischargeable forward.

The shelf unit 21 is supported by a cantilever 110, which extends forward from the rear wall 13 of the storage space 2, and the cantilever 110 is supported by a cantilever fixing rail 710, which is fixed to the rear wall 13 of the storage space 2.

In FIG. 1, a left storage compartment and a right storage compartment, which are disposed in the lowermost region and are divided by a partition, are illustrated by way of example, the right storage compartment may include a first drawer 25, which is disposed near the first door 20, and the left storage compartment may include a second drawer 27, which is located near the second door 40. In some examples, the first drawer 25 and the second drawer 27 may be disposed in the same horizontal plane. That is, the first drawer 25 and the second drawer 27 may be arranged on the left and right sides respectively at the same height within the storage space 2. The first drawer 25 and the second drawer 27 may be discharged independently of each other.

The first drawer 25 and the second drawer 27 may have the same width. That is, the first drawer 25 and the second drawer 27 may have the same storage capacity, and may be replaced with each other. Assuming that the first drawer 25 and the second drawer 27 have different widths, and thus different shapes, the first drawer 25 and the second drawer 27 need to be differently manufactured, which may inevitably increase manufacturing costs. On the other hand, assuming that the two drawers 25 and 27 have the same shape, manufacturing costs thereof may be advantageously reduced.

In some implementations, as described above, when the first door 20 is opened and the first drawer 25 is discharged in the state in which the second door 40 seals the storage space 2, the pillar 47 may not be located in the path along which the first drawer 25 is discharged.

In some implementations, the first door 20 and the second door 40 may have a same width. The first door 20 and the second door 40 may share some of the production processes thereof, which may reduce the production costs of the doors 20 and 40.

Figure 2:
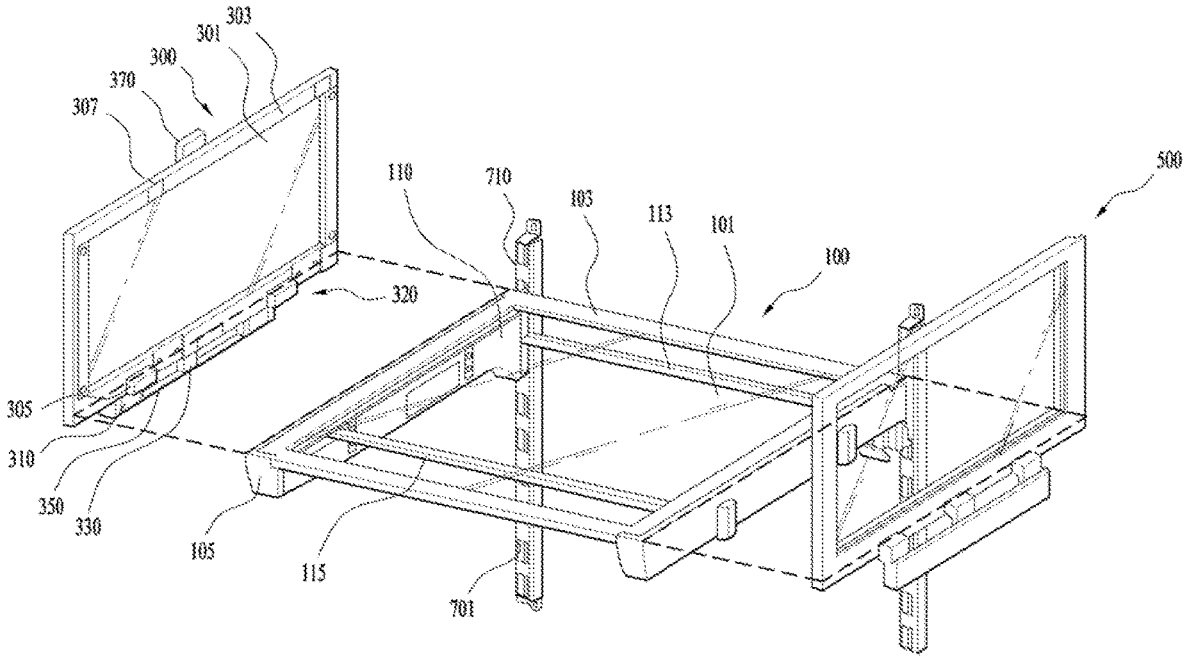
FIG. 2 is a perspective view illustrating an example coupled state of an example sliding shelf and an example folding shelf illustrated in FIG. 1.

Hereinafter, the shelf unit 21 of the refrigerator according to the implementation of the present disclosure will be described in detail with reference to FIGS. 2 and 3.

As described above, in examples where a single door is provided, the shelf unit 21 may include a single folding shelf 300 or 500 and a single sliding shelf 100. In examples where a plurality of doors such as the first door 20 and the second door 40 are provided, the shelf unit 21 may include the first folding shelf 300, the second folding shelf 500, and the sliding shelf 100, which is provided between the folding shelves so as to be dischargeable forward.

Here, the second folding shelf 500 has the same configuration and operating principle as the first folding shelf 300, excluding the fact that it is provided on the right surface of the storage compartment 23. The following description related to the first folding shelf 300 is entirely applied to the second folding shelf 500, and a description related to the second folding shelf 500 is excluded.

The sliding shelf 100 is provided on the rear surface of the storage compartment 23 so as to be dischargeable forward. In some examples, the sliding shelf 100 includes a sliding article-support portion 101, which may support an article, a sliding support frame 103, which is formed to surround the sliding article-support portion 101 and supports the sliding article-support portion 101, a pair of sliding frames 105, which is provided under the sliding support frame 103 so as to extend in a discharge direction, a rail unit 150, which provides a movement path of the sliding frames 105, and a rail support unit 130, which movably supports the rail unit 150.

The sliding article-support portion 101 is, for example, made of transparent reinforced glass, but is not limited to a specific material, and may include any other material that has a high strength and that is transparent, such as reinforced plastic.

The sliding support frame 103 may be formed of a high-strength metal to surround and support the sliding article-support portion 101, without being limited thereto.

The cantilever 110 is provided on the rear wall of the storage compartment 23 so as to extend forward. The cantilever 110 supports the rail support unit 130. The cantilever 110 is formed with a rail insertion portion 111, which is inserted into a cantilever fixing rail 710, which will be described later.

In order to allow a pair of cantilevers 110 to be firmly coupled to cantilever fixing rails 710 without a risk of transverse movement, a rear frame 113 and a front frame 115 are provided on the cantilevers 110.

The rear frame 113 is provided on the rear ends of the cantilevers 110 so as to cross the extending direction of the cantilevers 110, and the front frame 115 is also provided on the front ends of the cantilevers 110 so as to cross the extending direction of the cantilevers 110. The rear frame 113 and the front frame 115 connect the pair of cantilevers 110.

The cantilever fixing rail 710 is fixedly provided on the rear wall of the storage space 2 so as to fix the cantilever 110 to the rear wall of the storage space 2. The cantilever fixing rail 710 is formed with cantilever insertion recesses 711, into which the rail insertion portion 111 is inserted, such that the cantilever insertion recesses 711 are vertically spaced apart from each other by a constant distance.

In order to ensure that the rear end of the sliding shelf 100 is located close to the front end of the cantilever 110 when the sliding shelf 100 is fully discharged, the rail unit 150 may include a first rail 151 and a second rail 153, which is movably coupled to the first rail 151.

In the rail unit 150, for example, the first rail 151 may be fixed to the rail support unit 130, and the second rail 153 may be fixed to the bottom of the sliding frame 105. In this case, the second rail 153 may be coupled to the sliding frame 105 so as to extend rearward from the rear end of the sliding shelf 100, and may be coupled to the first rail 151 so as not to be upwardly separated from the first rail 151. Thus, the sliding shelf 100 may be fully discharged.

The rail support unit 130 is disposed under the rail unit 150, and is fixed to the outer surface of the cantilever 110 to support the rail unit 150.

The first folding shelf 300 is vertically rotatably provided on the side surface of the storage compartment 23. Specifically, the first folding shelf 300 is provided on the left surface of the storage compartment 23. In addition, the first folding shelf 300 may be set to a first position at which the first folding shelf 300 is disposed in the horizontal direction so as to form the same plane as the sliding shelf 100 (see FIG. 3) or a second position at which the first folding shelf 300 is rotated from the first position so as to be disposed in the vertical direction of the storage compartment 23 (see FIG. 2). For example, the first folding shelf 300 is selectively set to the first position and the second position based on rotation of the first folding shelf 300. The horizontal direction is the direction approximately parallel to the ground, and the vertical direction may be approximately the direction in which gravity force is oriented.

When the first folding shelf 300 is set to the first position, the first folding shelf 300 may define a continuous plane together with the sliding shelf 100. In other examples, when the first folding shelf 300 is set to the first position, the first folding shelf 300 may be located on a plane extending from the sliding shelf 100 and spaced apart by a certain distance from a side of the sliding shelf 100.

The first folding shelf 300 includes a first article-support portion 301, which supports an article, and a first folding support frame 303, which surrounds and supports the first article-support portion 301.

The first article-support portion 301 is formed of a high-strength transparent material such as a reinforced plastic. The first folding support frame 303 is rotatably provided on the side surface of the storage space 2 by a first hinge unit 310, and is formed of a high-strength material such as a metal.

The first folding shelf 300 may further include a first rotation stopper 330 and a first supporter 320.

The first supporter 320 is provided on the side surface of the storage compartment 23 to prevent sagging of the first folding shelf 300, which is disposed at the first position. In other words, the first supporter 320 prevents the first folding shelf 300, which is rotated downward from the second position and is set to the first position, from being further rotated downward. This will be described later.

The first rotation stopper 330 is provided on the side surface of the storage compartment 23 to resist rotation of the folding shelf. For example, the first rotation stopper 330 may apply resistance to the first folding shelf 300 to prevent the first folding shelf 300 from being easily rotated when the first folding shelf 300 is rotated and separated from the first position or the second position.

The first rotation stopper 330 may prevent rotation of the first folding shelf 300 until a predetermined force is applied to the first folding shelf 300 when the user attempts to separate the first folding shelf 300 from the first position or the second position. In other words, the first folding shelf 300 set to the first position or the second position may maintain the set position until predetermined external force is applied to the first folding shelf 300.

In some implementations, a first fixing unit 350 is provided on the side surface of the storage compartment 23 to fix and support the first hinge unit 310 and the first rotation stopper 330. Each of the first hinge unit 310 and the first rotation stopper 330 may be fixed to the side surface of the storage compartment 23, but may be fixed to the first fixing unit 350 in order to prevent stress from being concentrated on the side surface of the storage compartment 23. This will be described in detail.

Hereinafter, a configuration to support the first folding shelf 300 will be described in detail with reference to FIGS. 4 to 8.

Figure 4:
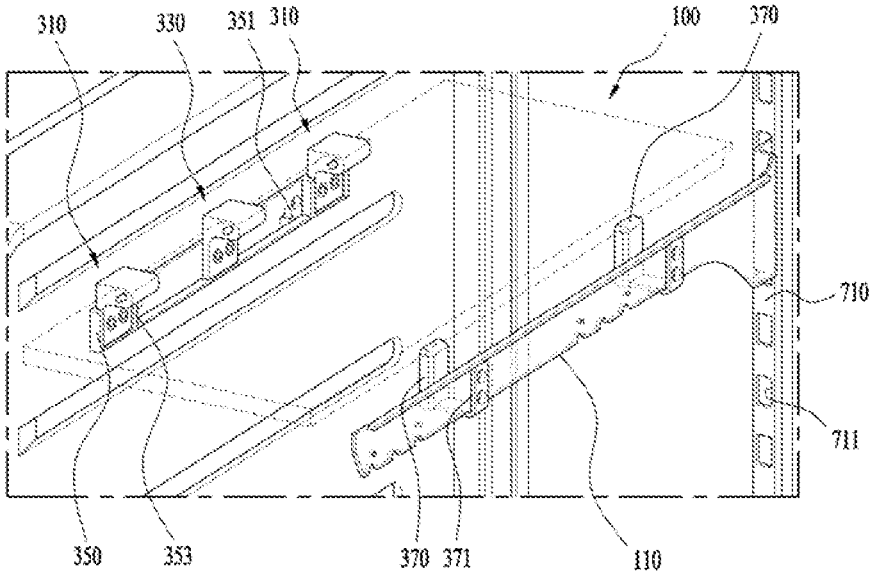
FIG. 4 is a perspective view illustrating an example structure configured to support the folding shelf illustrated in FIG. 1.
Figure 5:
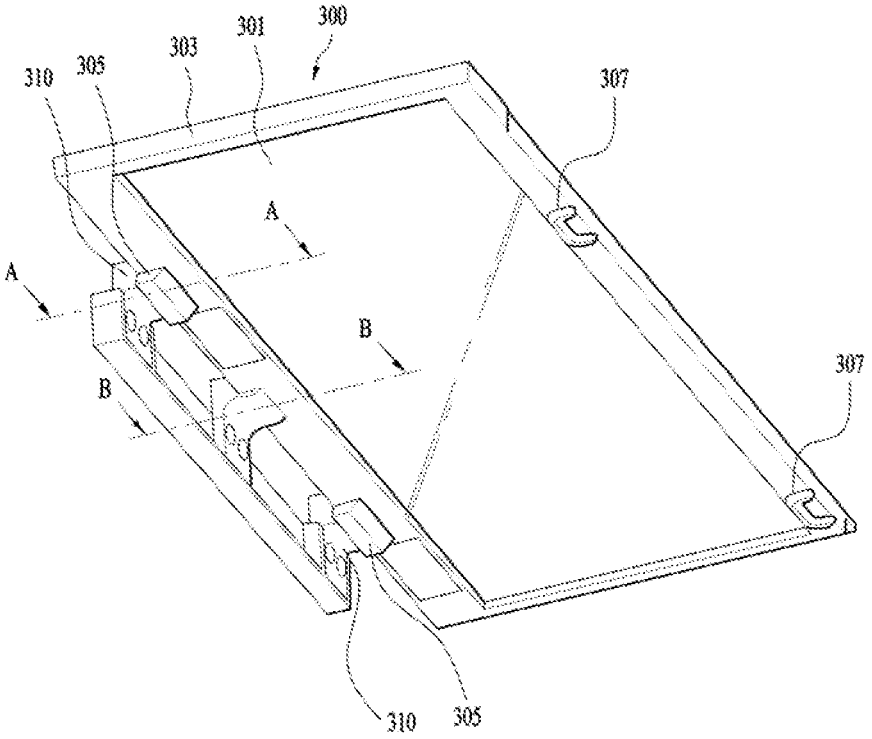
FIG. 5 is a perspective view illustrating an example coupled state of the folding shelf and the folding shelf support structure illustrated in FIG. 4.
Figure 6:
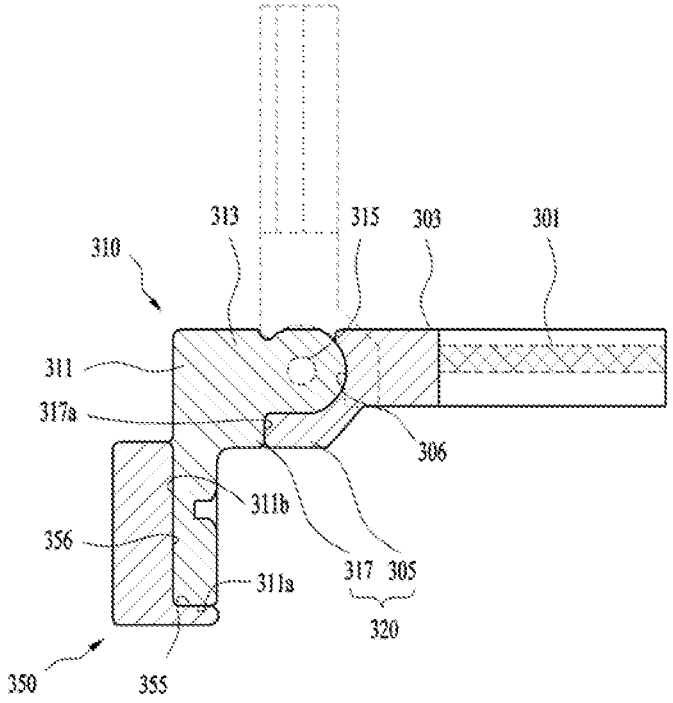
FIG. 6 is a sectional view illustrating a cross section of an example supporter taken along line A-A illustrated in FIG. 5.
Figure 7:
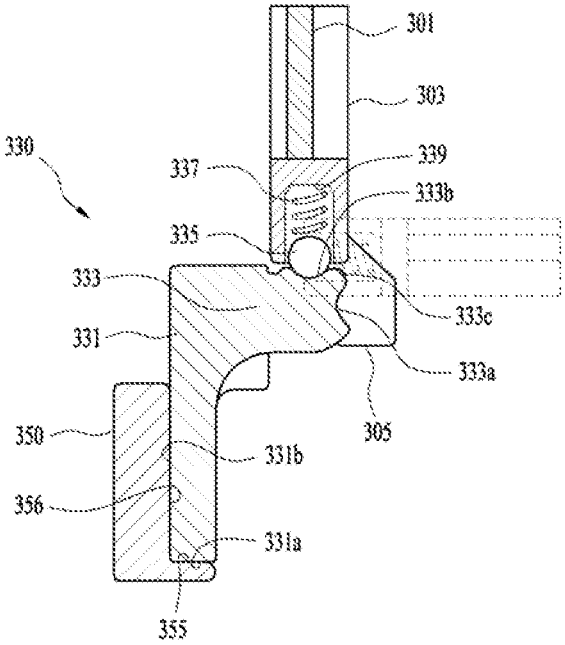
FIG. 7 is a sectional view illustrating a cross section of an example rotation stopper taken along line B-B illustrated in FIG. 5.
Figure 8:
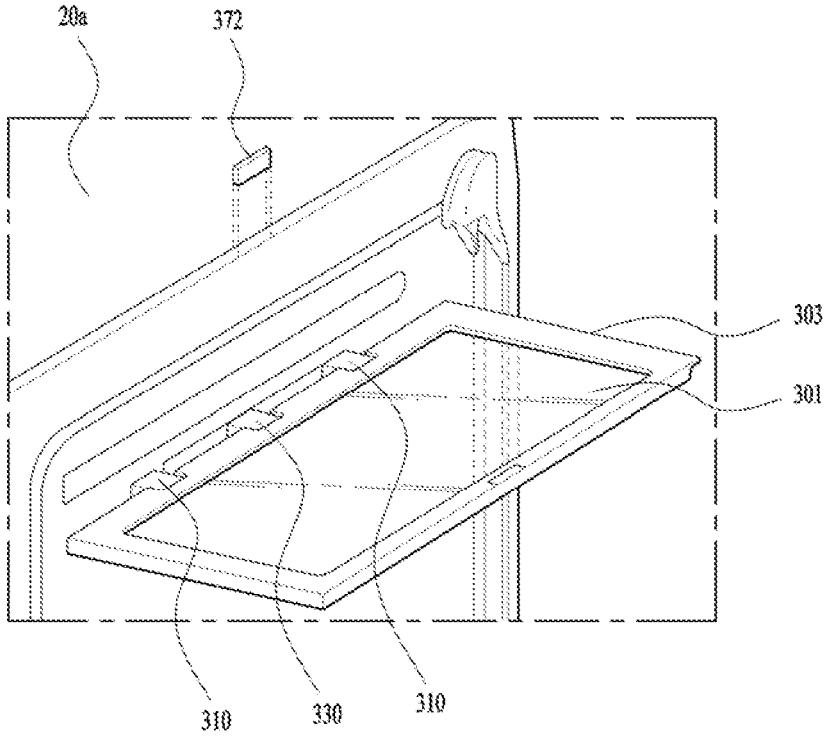
FIG. 8 is a view illustrating an example separable coupler.

FIG. 4 is a perspective view illustrating a structure for supporting the folding shelf 300 illustrated in FIG. 1, FIG. 5 is a perspective view illustrating a coupled state of the first folding shelf 300 and the folding shelf support structure illustrated in FIG. 4, FIG. 6 is a view illustrating the cross section of the supporter taken along line A-A illustrated in FIG. 5, FIG. 7 is a view illustrating the cross section of the rotation stopper taken along line B-B illustrated in FIG. 5, and FIG. 8 is a view illustrating a separable coupler.

The first fixing unit 350 is fixed to the side surface of the storage compartment 23, and extends from the rear end toward the front end of the storage compartment 23. The first fixing unit 350 has one side fixed to the side surface of the storage compartment 23, and the other side opposite the one side formed with a first fixing groove 351 in which the first hinge unit 310 and the first supporter 320 are seated and fixed.

The first fixing groove 351 includes a bottom surface 355 forming the bottom and a rear surface 356 extending upward from the bottom surface 355, which respectively support the first hinge unit 310 and the first supporter 320. In addition, the first fixing groove 351 may include first partitions 353 so that the first hinge unit 310 and/or the first supporter 320 are disposed between the first partitions 353 and supported by the first partitions 353.

The first hinge unit 310 may have any of various forms. In one example, the first hinge unit 310 includes a first hinge body 311, which is seated in the first fixing groove 351, and a first hinge arm 313, which protrudes from the first hinge body 311 to rotatably support the first folding shelf 300. The first hinge arm 313 may be integrally provided with a pair of protrusion shafts to support the first folding shelf 300, but may support a first hinge shaft 315, which rotatably supports the first folding shelf 300.

The first hinge body 311 includes a first body rear surface 311*b*, which is fixed to and supported by the rear surface of the first fixing groove 351, and a first body bottom surface 311*a*, which is fixed to and supported by the bottom surface of the first fixing groove 351.

The first hinge arm 313 extends inward of the storage compartment 23 from the surface opposite the first body rear surface 311*b*. The first hinge arm 313 is inserted into a first hinge insertion groove 306, which is indented in the side end of the first folding shelf 300, in order to rotatably support the first folding shelf 300.

The first hinge insertion groove 306 is indented in the side surface of the first folding shelf 300 and in a portion of the top surface close to the side surface.

The first supporter 320 includes a first protrusion 305, which is provided on the bottom surface of the first folding shelf 300, and a first press portion 317, which is provided on the first hinge unit 310 to selectively press the first protrusion 305. That is, when the first folding shelf 300 is rotated from the second position to thereby be set to the first position, the first press portion 317 may press the first protrusion 305 to prevent the first folding shelf 300 from being further rotated downward.

The first press portion 317 is provided between the first hinge body 311 and the first hinge arm 313. With the configuration of the first hinge unit 310 according to the above-described implementation, the first press portion 317 protrudes from the bottom of the first hinge arm 313, or protrudes from the side surface of the first hinge body 311. In addition, the first press portion 317 includes a first pressure surface 317*a*, which is aligned parallel to the side surface of the first folding shelf 300 so as to press the first protrusion 305. Thus, the first press portion 317 horizontally presses the first protrusion 305.

The first protrusion 305 protrudes from the bottom of the first hinge insertion groove 306. The first protrusion 305 has a width greater than the width of the first hinge insertion groove 306, and therefore, increases the strength of the first folding shelf 300 having the first hinge insertion groove 306 formed therein. Thus, the width of the first hinge insertion groove 306 is not easily increased by external force. The first protrusion 305 may be formed so as to come into surface contact with the first pressure surface 317*a*.

The first rotation stopper 330 may be manufactured in various forms. In one example, the first rotation stopper 330 includes a first fixing body 331, which is fixed to the side surface of the storage compartment 23, a first protruding arm 333, which protrudes from the first fixing body 331 and has a plurality of holding grooves formed therein, and a first holder 335, which is elastically pressed by the first folding shelf 300 so as to be selectively accommodated in one of the holding grooves.

The fixing body includes a body side surface facing the side surface of the storage compartment 23, and a bottom surface facing the lower side. The body side surface may be fixed to the side surface of the storage compartment 23.

The protruding arm is provided on the surface of the fixing body opposite the body side surface so as to extend toward the first folding shelf 300. The protruding arm includes the plurality of holding grooves formed in the distal end, and a stepped portion 333*c* formed between the holding grooves.

The holding grooves include a first holding groove 333*a*, which is horizontally indented in the distal end of the protruding arm, and a second holding groove 333*b*, which is vertically indented in the distal end of the protruding arm.

The stepped portion 333*c* is formed between the first holding groove 333*a* and the second holding groove 333*b*, and protrudes upward toward the inside of the storage compartment 23.

The first holder 335 is accommodated in a first guide groove 339 formed in the side surface of the first folding shelf 300. In FIG. 7, in one example, the first holder 335 having a spherical shape is illustrated, without being limited thereto, and the first holder 335 may have any other of various shapes. The first guide groove 339 accommodates a first pressure spring 337, which elastically supports the first holder 335 against the first protruding arm 333.

In some examples, in order to allow the first folding shelf 300 to deviate from the first position and be set to the second position, in other words, in order to allow the first holder 335, which is pressed by the first pressure spring 337, to be separated from the first holding groove 333*a* and then be accommodated in the second holding groove 333*b*, sufficient rotational force needs to be applied to the first folding shelf 300. The reverse case is also the same.

In some implementations, the first hinge unit 310 supports most of the weight of the first folding shelf 300. In contrast, the first rotation stopper 330 supports only a part of the weight of the first folding shelf 300. Thus, a plurality of first hinge units 310 may be provided in order to reduce the weight to be applied to each first hinge unit 310, which may increase the lifespan of the first hinge unit 310 and the lifespan of the inter-coupling portion of the first hinge unit 310 and the first fixing unit 350.

In this case, the first rotation stopper 330 may be disposed between the first hinge units 310. That is, the first hinge units 310 are provided respectively close to the front end and the rear end of the first folding shelf 300 so as to allow the first folding shelf 300 to stably rotate without a risk of separation from the first fixing unit 350. The first rotation stopper 330 cannot prevent the first folding shelf 300 from being separated from the first fixing unit 350, and therefore, is provided between the front end and the rear end of the first folding shelf 300.

In some implementations, the first folding shelf 300 may further include a first side-end support piece 370, which prevent the first folding shelf 300 from being further rotated downward from the first position.

The first side-end support piece 370 is supported by a first fixing bracket 371, which is fixed to the cantilever 110, and is configured to vertically extend. The first side-end support piece 370 supports the inner side end of the first folding shelf 300 opposite the outer side end, which is supported by the first hinge unit 310. Here, the outer side end is located close to the side surface of the storage space 2, and the inner side end of the first folding shelf 300 is located close to the sliding shelf 100 at the first position of the first folding shelf 300.

The first side-end support piece 370 may support the bottom surface of the first folding shelf 300, and a first accommodating protrusion 307 may be located at the bottom surface of the inner side end of the first folding shelf 300 so as to accommodate the first side-end support piece 370 therein. The first accommodating protrusion 307 accommodates the first side-end support piece 370, and prevents horizontal movement of the first folding shelf 300, which is set to the first position. In addition, the first side-end support piece 370 may support the weight of the first folding shelf 300, thus functioning to reduce the weight of the first folding shelf 300 applied to the first hinge unit 310.

Figure 3:
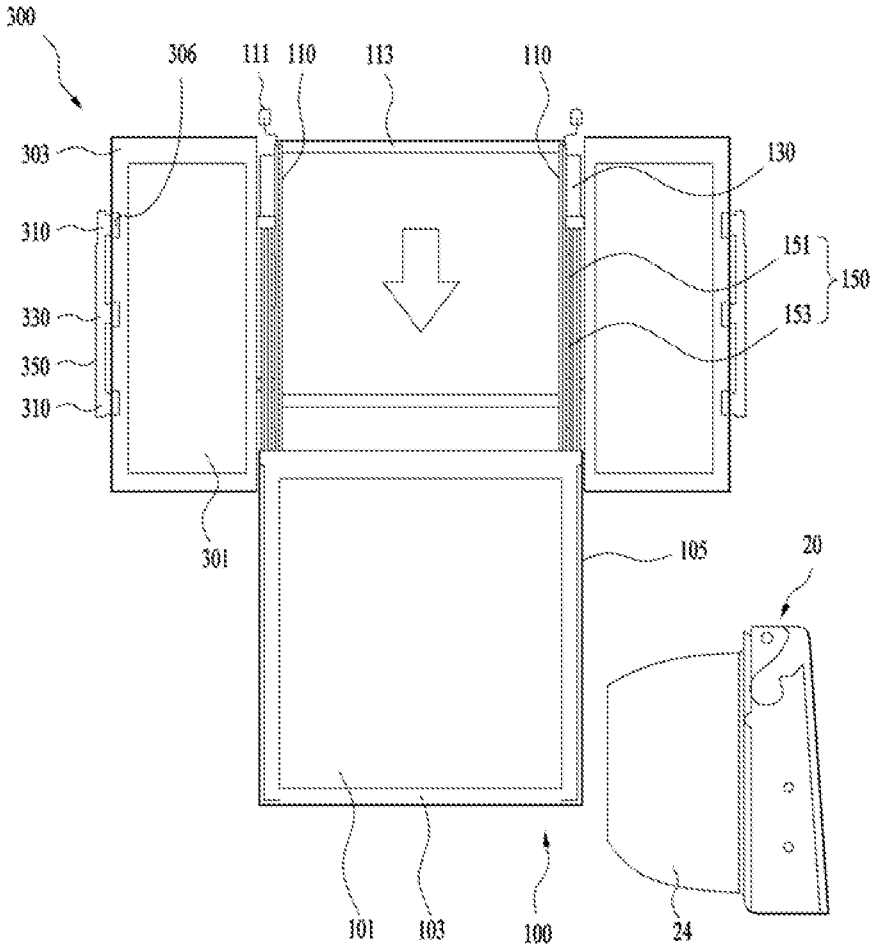
FIG. 3 is a view illustrating an example discharge operation of the sliding shelf illustrated in FIG. 1.

In some examples, when the door is rotated to open the storage compartment 23, as illustrated in FIG. 3, one side of the basket 24 is located on the front side of the storage compartment 23. When a user attempts to discharge the sliding shelf 100, the sliding shelf 100 may not be fully discharged due to interference with the basket 24.

The first and second folding shelves 300 and 500 may have a predetermined width so as to prevent the sliding shelf 100 from interfering with the basket 24 when the sliding shelf 100 is discharged forward. When a single door is provided, for example, one of the first and second folding shelves 300 and 500 may have a predetermined width to prevent the sliding shelf 100 from interfering with the basket 24. When a pair of doors 20 and 40 is provided, the respective first and second folding shelves 300 and 500 may have a predetermined width to prevent the sliding shelf 100 from interfering with the basket 24.

When each or any one of the first and second folding shelves 300 and 500 has a predetermined width to prevent the sliding shelf 100 from interfering with the basket 24, the sliding shelf 100 is spaced apart from the side surface of the storage space 2 by the aforementioned predetermined width. As a consequence, the sliding shelf 100 may be discharged forward without interference with the basket 24.

For example, in the case of a double door refrigerator having the first door 20 and the second door 40, the width of the sliding shelf 100 is not be greater than the distance between the basket 24 of the first door 20 and the second door 40.

In some implementations, as illustrated in FIG. 8, a separable coupler 372 may be fixed to the side surface of the storage compartment 23 so as to be separably coupled to the first folding shelf 300, which is disposed at the second position. The separable coupler 372 is configured so as to be separably coupled to the first folding support frame 303, like a magnet. To this end, the first folding support frame 303 is formed of a metal so that magnetic force acts thereon.

Hereinafter, the use of the first and second folding shelves 300 and 500 and the sliding shelf 100 will be described in detail.

The second folding shelf 500 has the same configuration as the first folding shelf 300, and thus a repeated description thereof is omitted herein.

The user may easily access the sliding shelf 100 by discharging the sliding shelf 100, which occupies about half the entire area of the shelf unit.

The distance that the sliding shelf 100 is discharged forward is preset.

The sliding shelf 100 may be set so as to be fully discharged because the distance that the sliding shelf 100 is discharged forward is preset and does not interfere with the basket 24.

In some examples, the first folding shelf 300 may occupy one quarter of the entire area of the shelf unit. The user may upwardly rotate and fold at least one of the first folding shelf or the second folding shelf so as to store a tall article under the folding shelf.

That is, the user may upwardly rotate at least one of the first or second folding shelf 300 or 500, which is set to the first position, so as to set the same to the second position.

When the first folding shelf 300 is set to the first position, the weight of the first folding shelf 300 is supported by the side-end support piece and the first supporter 320.

In order to upwardly rotate the first folding shelf 300 so as to set the first folding shelf 300 to the second position, the user needs to apply an amount of force corresponding to a portion of the weight of the first folding shelf 300 as well as additional force required to overcome the resistance applied by the first rotation stopper 330.

When the first folding shelf 300 is set to the second position, the user can store a tall article on a shelf under the first folding shelf.

In some implementations, the first folding shelf 300, which is set to the second position, is not easily rotated downward by the first rotation stopper 330 and the separable coupler. This is because force greater than the resistance of the first rotation stopper 330 and the attractive force of the separable coupler need to be applied.

When the user applies force that is greater than the resistance of the first rotation stopper 330 and the attractive force of the separable coupler to the first folding shelf 300, which is set to the second position, the first folding shelf 300 is rotated downward and is set to the first position.

As apparent from the above description, a refrigerator described in the present disclosure may have one or more of the following effects.

For example, the refrigerator may allow a shelf to discharge forward to a sufficient distance without interfering with a basket provided on a door, which may improve accessibility to the shelf for a user.

In some examples, the refrigerator may include a foldable shelf as well as a shelf that is dischargeable forward to store a tall article.

In some examples, the refrigerator may include a plurality of foldable shelves that are provided on opposite side surfaces of a storage compartment of the refrigerator to store a larger number of tall items therein, and that are usable in an unfolded state when storing a short article, which results in a high spatial utility.

Although the exemplary implementations have been illustrated and described as above, it will be apparent to those skilled in the art that the implementations are provided to assist understanding of the present disclosure and the present disclosure is not limited to the above described particular implementations, and various modifications and variations can be made in the present disclosure without departing from the spirit or scope of the present disclosure, and the modifications and variations should not be understood individually from the viewpoint or scope of the present disclosure.

What is claimed is:

1. A refrigerator comprising:

a cabinet that defines a storage compartment and an opening at a front side of the storage compartment;

a door rotatably coupled to the cabinet and configured to open and close at least a portion of the storage compartment, the door comprising a basket;

a sliding shelf that is located in the storage compartment, that extends in a horizontal direction, and that is configured to discharge forward from the storage compartment;

a folding shelf located in the storage compartment and configured to switch positions between a first position in which the folding shelf is disposed along a plane of the sliding shelf and a second position in which the folding shelf is disposed transverse to the plane, the folding shelf being configured to switch to the second position based on rotation of the folding shelf from the first position;

a hinge unit configured to rotatably couple the folding shelf to a side surface of the storage compartment;

a rotation stopper located on the side surface of the storage compartment and configured to resist rotation of the folding shelf;

a supporter configured to support the folding shelf based on the folding shelf being disposed at the first position, the supporter comprising a protrusion located at a bottom surface of the folding shelf and a press portion that is located at a lower side of the hinge unit and configured to apply pressure to the protrusion in the horizontal direction;

a fixing unit that faces the side surface of the storage compartment, that is configured to couple the hinge unit and the rotation stopper to the side surface of the storage compartment, and that is configured to support the hinge unit and the rotation stopper, the fixing unit protruding from the side surface of the storage compartment toward the hinge unit and the rotation stopper; and a cantilever that extends forward from a rear wall of the storage compartment, that is configured to slidably support the sliding shelf, and that is configured to selectively support the folding shelf based on the folding shelf being disposed at the first position, the cantilever being configured to detach from the rear wall of the storage compartment, wherein the door comprises a first door coupled to a first side of the cabinet and a second door coupled to a second side of the cabinet, wherein the folding shelf comprises:

a first folding shelf configured to couple to a first side surface of the storage compartment, and a second folding shelf configured to couple to a second side surface of the storage compartment that is opposite to the first side surface, and wherein each of the first folding shelf and the second folding shelf has a predetermined width to allow the sliding shelf to discharge forward without interference with the basket of the door based on the door opening the storage compartment.

2. The refrigerator according to claim 1, wherein the press portion includes a contact portion that extends in a direction parallel to a side surface of the folding shelf and that is configured to face the side surface of the folding shelf to apply pressure to the protrusion.

3. The refrigerator according to claim 1, wherein the folding shelf defines a hinge insertion groove configured to receive a side of the hinge unit, and wherein the protrusion is located vertically below the hinge insertion groove.

4. The refrigerator according to claim 3, wherein the hinge unit comprises:

a hinge body coupled to the side surface of the storage compartment; and a hinge arm that extends from the hinge body, that is configured to insert into the hinge insertion groove, and that is configured to rotatably support the folding shelf, and wherein the press portion is located between the hinge body and the hinge arm.

5. The refrigerator according to claim 1, wherein the fixing unit defines a fixing groove that is recessed from a side of the fixing unit and that is configured to receive the hinge unit and the rotation stopper.

6. The refrigerator according to claim 5, wherein the hinge unit comprises a plurality of hinge units, and the rotation stopper is located between the plurality of hinge units, and wherein the fixing groove is configured to receive all of the plurality of hinge units and the rotation stopper that are disposed at the side surface of the storage compartment.

7. The refrigerator according to claim 1, wherein a width of the sliding shelf is less than or equal to a distance between the basket of the door and a second side surface of the storage compartment based on the door opening the storage compartment.

8. The refrigerator according to claim 1, further comprising a shelf coupler that is located at the side surface of the storage compartment and that is configured to, based on the folding shelf being disposed at the second position, hold the folding shelf at the side surface of the storage compartment.

9. The refrigerator according to claim 1, wherein the sliding shelf comprises a plurality of sliding shelves that are arranged at different heights in the storage compartment, and wherein the folding shelf is configured to rotate from at least one of the plurality of sliding shelves to define a space configured to receive an object having a height greater than a distance between the plurality of sliding shelves.

10. The refrigerator according to claim 1, wherein the fixing unit has:

a first side surface that contacts the side surface of the storage compartment;

a second side surface that contacts side surfaces of the hinge unit and the rotation stopper; and a bottom surface that protrudes from the second side surface toward the hinge unit and the rotation stopper and that contacts bottom surfaces of the hinge unit and the rotation stopper.

11. The refrigerator according to claim 10, wherein the second side surface and the bottom surface of the fixing unit define a fixing groove that accommodates the hinge unit and the rotation stopper.

12. A refrigerator comprising:

a cabinet that defines a storage compartment and an opening at a front side of the storage compartment a door rotatably coupled to the cabinet and configured to open and close at least a portion of the storage compartment, the door comprising a basket a sliding shelf that is located in the storage compartment, that extends in a horizontal direction, and that is configured to discharge forward from the storage compartment;

a folding shelf located in the storage compartment and configured to switch positions between a first position in which the folding shelf is disposed along a plane of the sliding shelf and a second position in which the folding shelf is disposed transverse to the plane, the folding shelf being configured to switch to the second position based on rotation of the folding shelf from the first position;

a hinge unit configured to rotatably couple the folding shelf to a side surface of the storage compartment;

a rotation stopper located on the side surface of the storage compartment and configured to resist rotation of the folding shelf;

a supporter configured to support the folding shelf based on the folding shelf being disposed at the first position, the supporter comprising a protrusion located at a bottom surface of the folding shelf and a press portion that is located at a lower side of the hinge unit and configured to apply pressure to the protrusion in the horizontal direction;

a fixing unit that faces the side surface of the storage compartment, that is configured to couple the hinge unit and the rotation stopper to the side surface of the storage compartment, and that is configured to support the hinge unit and the rotation stopper;

a cantilever that extends forward from a rear wall of the storage compartment, that is configured to slidably support the sliding shelf, and that is configured to selectively support the folding shelf based on the folding shelf being disposed at the first position, the cantilever being configured to detach from the rear wall of the storage compartment; and a side-end support piece that is located at the cantilever and that is configured to support an inner side end of the folding shelf based on the folding shelf being disposed at the first position, wherein the door comprises a first door coupled to a first side of the cabinet and a second door coupled to a second side of the cabinet, wherein the folding shelf comprises:

a first folding shelf configured to couple to a first side surface of the storage compartment, and a second folding shelf configured to couple to a second side surface of the storage compartment that is opposite to the first side surface, wherein each of the first folding shelf and the second folding shelf has a predetermined width to allow the sliding shelf to discharge forward without interference with the basket of the door based on the door opening the storage compartment, and wherein the hinge unit is configured to rotatably support an outer side end of the folding shelf that is opposite to the inner side end.

13. The refrigerator according to claim 12, wherein the rotation stopper is configured to apply resistance force to the folding shelf that restricts rotation of the folding shelf from the first position or from the second position.

14. The refrigerator according to claim 13, wherein the rotation stopper comprises:

a fixing body coupled to the side surface of the storage compartment;

a protruding arm that extends from the fixing body, that defines a plurality of holding grooves recessed from a distal end of the protruding arm, and that includes a stepped portion located between the plurality of holding grooves; and a holder configured to receive pressure from the folding shelf and to selectively insert to one of the plurality of holding grooves.

15. A refrigerator, comprising:

a cabinet that defines a storage compartment and an opening at a front side of the storage compartment;

a door rotatably coupled to the cabinet and configured to open and close at least a portion of the storage compartment, the door comprising a basket;

a sliding shelf that is located in the storage compartment, that extends in a horizontal direction, and that is configured to discharge forward from the storage compartment;

a folding shelf located in the storage compartment and configured to switch positions between a first position in which the folding shelf is disposed along a plane of the sliding shelf and a second position in which the folding shelf is disposed transverse to the plane, the folding shelf being configured to switch to the second position based on rotation of the folding shelf from the first position;

a hinge unit configured to rotatably couple the folding shelf to a side surface of the storage compartment;

a rotation stopper located on the side surface of the storage compartment and configured to resist rotation of the folding shelf;

a supporter configured to support the folding shelf based on the folding shelf being disposed at the first position, the supporter comprising a protrusion located at a bottom surface of the folding shelf, and a press portion is located at a lower side of the hinge unit and configured to apply pressure to the protrusion in the horizontal direction;

a fixing unit that faces the side surface of the storage compartment, that is configured to couple the hinge unit and the rotation stopper to the side surface of the storage compartment, and that is configured to support the hinge unit and the rotation stopper; and a cantilever that extends forward from a rear wall of the storage compartment, that configured to slidably support the sliding shelf, and that is configured to selectively support the folding shelf based on the folding shelf being disposed at the first position, the cantilever being configured to detach from the rear wall of the storage compartment, wherein the door comprises a first door coupled to a first side of the cabinet and a second door coupled to a second side of the cabinet, wherein the folding shelf comprises:

a first folding shelf configured to couple to a first side surface of the storage compartment, and a second folding shelf configured to couple to a second side surface of the storage compartment that is opposite to the first side surface, wherein each of the first folding shelf and the second folding shelf has a predetermined width to allow the sliding shelf to discharge forward without interference with the basket of the door based on the door opening the storage compartment, wherein the first door comprises a first basket, and the second door comprises a second basket, wherein a width of the sliding shelf is less than or equal to a distance between the first basket and the second basket based on the first door and the second door opening the storage compartment, and wherein the sliding shelf is located between the first folding shelf and the second folding shelf.

16. The refrigerator of claim 15, wherein the hinge unit includes a first hinge unit located at the first side surface of the storage compartment, and a second hinge unit located at the second side surface of the storage compartment, wherein the first folding shelf is configured to rotate about the first hinge unit from the first position toward the first side surface of the storage compartment, and wherein the second folding shelf is configured to rotate about the second hinge unit from the first position toward the second side surface of the storage compartment.

17. The refrigerator of claim 16, wherein a distance between an end of the first folding shelf positioned away from the first hinge unit in the first position to an end of the second folding shelf positioned away from the second hinge unit in the first position is less than or equal to the distance between the first basket and the second basket based on the first door and the second door opening the storage compartment.

18. A refrigerator comprising:

a cabinet that defines a storage compartment and an opening at a front side of the storage compartment;

a door rotatably coupled to the cabinet and configured to open and close at least a portion of the storage compartment, the door comprising a basket;

a sliding shelf that is located in the storage compartment, that extends in a horizontal direction, and that is configured to discharge forward from the storage compartment;

a folding shelf located in the storage compartment and configured to switch positions between a first position in which the folding shelf is disposed along a plane of the sliding shelf and a second position in which the folding shelf is disposed transverse to the plane, the folding shelf being configured to switch to the second position based on rotation of the folding shelf from the first position;

a hinge unit configured to rotatably couple the folding shelf to a side surface of the storage compartment;

a rotation stopper located on the side surface of the storage compartment and configured to resist rotation of the folding shelf;

a supporter configured to support the folding shelf based on the folding shelf being disposed at the first position, the supporter comprising a protrusion located at a bottom surface of the folding shelf, and a press portion that is located at a lower side of the hinge unit and configured to apply pressure to the protrusion in the horizontal direction;

a fixing unit that faces the side surface of the storage compartment, that is configured to couple the hinge unit and the rotation stopper to the side surface of the storage compartment, and that is configured to support the hinge unit and the rotation stopper; and a cantilever that extends forward from a rear wall of the storage compartment, that configured to slidably support the sliding shelf, and that is configured to selectively support the folding shelf based on the folding shelf being disposed at the first position, the cantilever being configured to detach from the rear wall of the storage compartment, wherein the door comprises a first door coupled to a first side of the cabinet and a second door coupled to a second side of the cabinet, wherein the folding shelf comprises:

a first folding shelf configured to couple to a first side surface of the storage compartment, and a second folding shelf configured to couple to a second side surface of the storage compartment that is opposite to the first side surface, wherein each of the first folding shelf and the second folding shelf has a predetermined width to allow the sliding shelf to discharge forward without interference with the basket of the door based on the door opening the storage compartment, wherein the hinge unit comprises a plurality of hinge units, and the rotation stopper is located between the plurality of hinge units, and wherein the fixing unit has:

a first side that is fixed to the side surface of the storage compartment, and a second side to which the hinge unit and the rotation stopper are fixed.

19. The refrigerator according to claim 18, wherein the fixing unit protrudes from the side surface of the storage compartment toward the hinge unit and the rotation stopper.

20. The refrigerator according to claim 19, wherein the plurality of hinge units comprise a first hinge unit and a second hinge unit that are spaced apart from each other in a front-rear direction of the storage compartment, and wherein the rotation stopper is located between the first hinge unit and the second hinge unit and spaced apart from the first hinge unit and the second hinge unit in the front-rear direction of the storage compartment.

* * * * *